United States Patent [19]

Atieh et al.

[11] 4,452,457

[45] Jun. 5, 1984

[54] FINANCIAL BOARD GAME

[76] Inventors: Sabah Atieh; Jennifer M. Atieh, both of 301 Woodfield Rd., West Hempstead, N.Y. 11552

[21] Appl. No.: 320,176

[22] Filed: Nov. 12, 1981

[51] Int. Cl.[3] ..... A63F 3/00

[52] U.S. Cl. ..... 273/256

[58] Field of Search ..... 273/256, 278, 257, 243

[56] References Cited

U.S. PATENT DOCUMENTS

| | | | |
|---|---|---|---|
| 2,174,058 | 9/1939 | McGennis | 273/256 |
| 2,666,644 | 1/1954 | Strehlow et al. | 273/256 |
| 2,691,528 | 10/1954 | Laidlaw | 273/256 |
| 3,163,424 | 12/1964 | Lindsey | 273/278 |
| 3,198,521 | 8/1965 | Kramer et al. | 273/256 |
| 3,885,792 | 5/1975 | Breslow | 273/256 |
| 4,002,342 | 1/1977 | Biggs | 273/256 X |
| 4,189,153 | 2/1980 | Zollinger | 273/256 |
| 4,312,510 | 1/1982 | Bodner | 273/256 |

*Primary Examiner*—Richard C. Pinkham
*Assistant Examiner*—Scott Brown
*Attorney, Agent, or Firm*—Bollo & Drumm

[57] ABSTRACT

A financial board game having a closed loop path divided into a plurality of discrete spaces interconnected to one another with each space providing an instruction for a player whose token lands thereon, a stock market pricing display including a plurality of stocks each of which has a plurality of indicia of stock values associated therewith, some of the discrete spaces having instructions indicating that a particular stock has gone up or down in value and other discrete spaces having instructions indicating that shares of a particular stock may be purchased. A marker movable in response to instructions from spaces of the closed loop path for collectively displaying the current indicia for each of the stocks. Control of a particular stock is obtained by a player accumulating a predetermined number of shares of the stock which represents control, thereby requiring the other players to pay a multiple of the current value of stock displayed by the stock market pricing display for each share of the controlled stock they purchase. Advantageously, an inner path interconnects with the closed loop path and includes interconnected discrete spaces some of which include instructions for forming a private corporation. A private corporation pricing display determines the selling price of each private corporation.

9 Claims, 9 Drawing Figures

FINANCIAL BOARD GAME

BACKGROUND OF THE INVENTION

The present invention relates to financial board game, and more specifically to a financial board game having a defined path along which chance movement by the players causes a collective change in the value of the stocks displayed at a stock market pricing display.

Financial board games are known in the art. Examples of such games include U.S. Pat. No. 2,666,644 (Strehlow et al.) and U.S. Pat. No. 3,198,521 (Kramer et al.). However, none of these known games provide a satisfactory interaction of simulated market forces to achieve a highly realisitc, yet varied, financial game which simulates stock market behavior and also advantageously combines elements of private enterprise in the formation and sale of private corporations.

SUMMARY OF THE INVENTION

It is an object of the present invention to provide a realistic financial board game.

It is a further object of the present invention to provide a financial board game which behaves in a coordinated but unpredictable way.

It is a still further object of the present invention to provide a financial board game which simulates both realisitc stock market behavior and the elements of private entrepreneurship.

It is a still further object of the present invention to provide a financial board game which plays realistically while building interest and excitement during the course of the game.

It is also a further object of the present invention to provide a financial board game which may serve as a financial teaching aid for those who play the game.

It is a still further object of the present invention to provide a financial board game which may be readily adapted for use with international exchange rates.

Briefly, in accordance with the present invention, a financial board game is provided which provides enjoyment to the players in addition to serving as a financial teaching aid, comprising a game board having a closed loop path divided into a plurality of discrete spaces interconnected to one another, each discrete space providing an instruction to a player whose token lands thereon during movement along the closed loop path, a stock market pricing display including a plurality of stocks each of which has a plurality of indicia of stock values associated therewith, some of the discrete spaces having instructions thereon indicating that a particular stock has risen or fallen in value and other discrete spaces having instructions thereon indicating that shares of a particular stock may be purchased, marker means movable in response to instructions from some of the discrete spaces of the closed loop path for collectively displaying the current indicia for each of the stocks, whereby a player whose token lands on a sufficient number of discrete spaces allowing purchase of a particular stock will gain control of the stock if the player accumulates a predetermined number of shares of the stock thereby requiring the other players to pay a multiple of the current value of such stock displayed by the stock market pricing display for each share of the controlled stock they purchase. Advantageously, an inner path interconnects with the closed loop path and includes interconnected discrete spaces some of which include instructions for forming a private corporation.

A private Corporation pricing display determines the selling price of each private corporation.

Other objects aspects and advantages of the present invention will be apparent when the detailed description is considered in conjunction with the preferred embodiment of the game illustrated in the drawings, as follows:

DETAILED DESCRIPTION OF THE PREFERRED EMBODIMENT

Figure 1A:
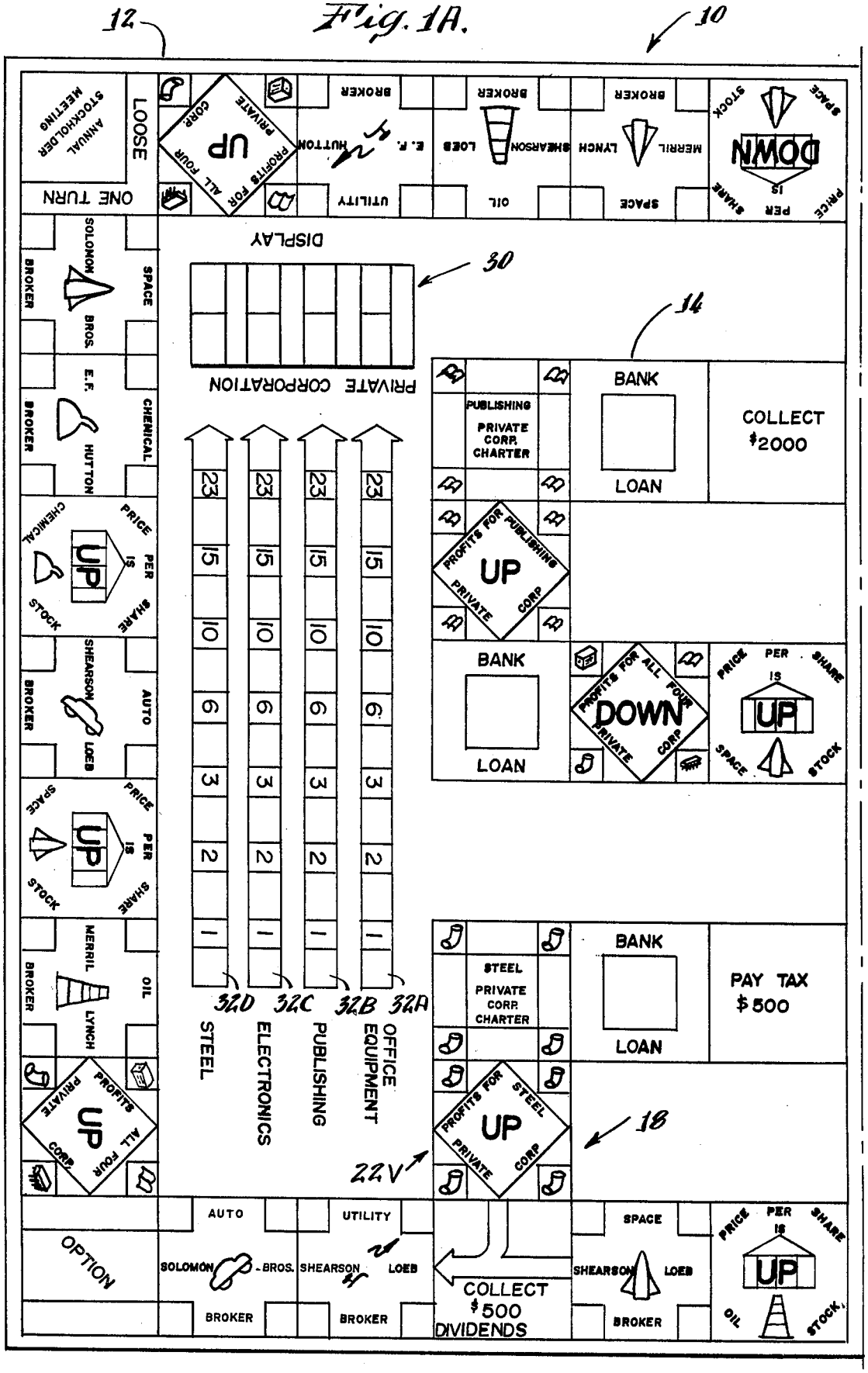
FIGS. 1A and B illustrate the preferred form of the game board of the present invention.
Figure 1B:
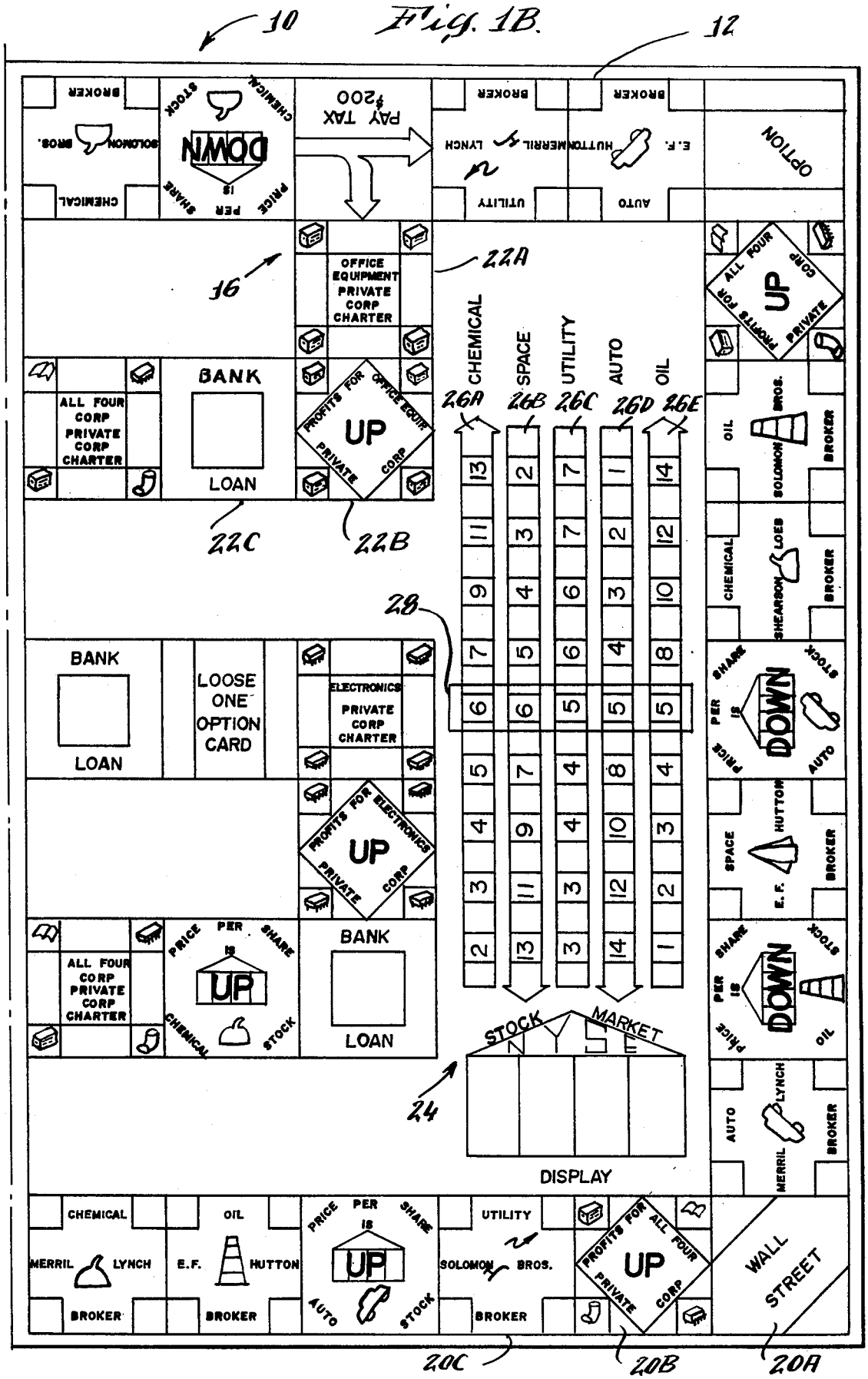

Referring to FIG. 1, the preferred form of the game board for the financial board game of the present invention is illustrated at 10. The board 10 includes an outer peripheral closed loop path 12 and an inner, preferably S-shaped or serpentine shaped, option path 14 which interconnects at its entrance end 16 and exit end 18 to the outer peripheral closed loop path 12. The outer peripheral closed loop path 12 is divided into a plurality of discrete and contiguous information carrying spaces or areas 20A, B, C, etc. Likewise, the inner path 14 includes a plurality of discrete and contiguous information carrying spaces or areas 22A, B, C, etc. Entrance onto the inner path 14 is by way of the contiguous space 22A marked "Private Corporation Charter—Office Equipment", and exit from the inner path 14 is by way of the contiguous space 22V marked "Profits For Steel-Up-Private Corporation".

Located on the right side of the board 10 as seen in FIG. 1 is a Stock Market Pricing Display, generally indicated at 24. The Display 24 preferably includes four vertical arrows 26A, B, D, and E and one vertical line 26C of different colors each representing a different industry, e.g., Chemical, Space, Auto, Oil, and Utility. The line 26C is centered between the two arrows 26A and B and 26D and E. The arrows 26B and D immediately adjacent the line 26C but on opposite sides thereof are pointed in one direction and the other two arrows 26A and E arranged on opposite sides of the line 26C are pointed in the opposite direction. Each of the arrows and the line 26A-E has a plurality of value indicia in the form of digits, preferably nine digits, arranged thereon. The nine digits are spaced along the line 26C and each of the arrows 26A and B and 26D and E so they they form nine horizontal columns. The particular sequence of digits chosen is 3,3,4,4,5,6,6,7 and 7 for line 26C; 2,3,4,5,6,7,9,11 and 13 for arrow 26A and a reversal of these digits for arrow 26B; 1,2,3,4,5,8,10,12, and 14 for arrow 26E and a reversal of these digits for arrow 26D.

A rectangularly shaped marker 28, which is preferably transparent, is initially placed over the middle horizontal column of digits as shown in FIG. 1. The digits framed by the marker 28 represent the current per share price of each share of stock for the various industries. The marker 28 is moved one column upward or downward along the line 26C and arrows 26A, B, D, and E in accordance with instructions from certain of the information spaces 20 and 22, as will be described in more detail below.

Located at the left side of the board 10 as seen in FIG. 1 is a Private Corporation Pricing Display 30 which includes preferably, four different colored vertical arrows 32A–D all pointed in the same direction and representing different industries, e.g., Office Equipment, Publishing, Electronics, and Steel. Preferably eight different pricing digits are spaced along each of the arrows 32A–D with the digits forming horizontal columns with the digits in each horizontal column being identical and the digits progressively increasing in the direction of the arrows. The particular sequence of digits chosen is 1, 2, 3, 6, 10, 15, and 23. The interaction between the Private Corporation Pricing Display 30 and the game board 10 will be discussed more fully below.

Some of the appurtenances for use with the game board 10 are illustrated in FIGS. 2–8.

Figure 2:
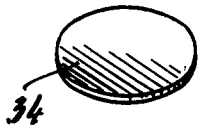
FIG. 2 illustrates one form which the player's tokens may take.

FIG. 2 illustrates one form of token 34 which may be utilized in the game. Each player selects a different color token 34. Six tokens are included with the game. The minimum number of players is two and the maximum number six for smooth play.

Figure 3:
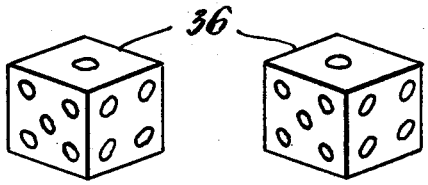
FIG. 3 shows a pair of dice for use in the game.

FIG. 3 shows a pair of dice 36 for use by the players to provide movement of the tokens 34 along the paths 12 and 14 of the game board 10 as will be more fully described below.

Figure 4:
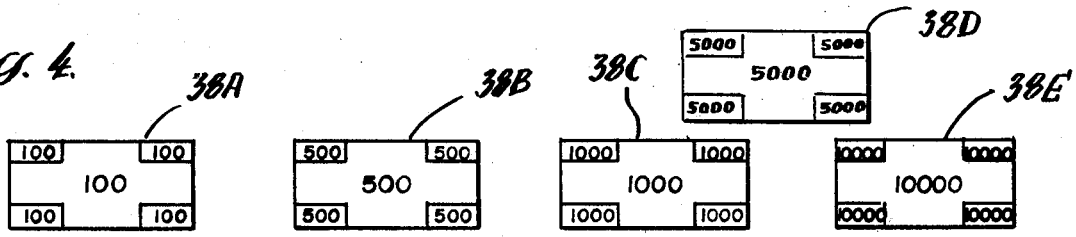
FIG. 4 shows one form for the money to be used in denominations of 100, 500, 1,000, 5000 and 10,000 dollars.

FIG. 4 illustrates one form which the money 38 used in the game may take. Preferably, the denominations are $100, $500, $1,000, and $5,000 and $10,000.

Figure 5:
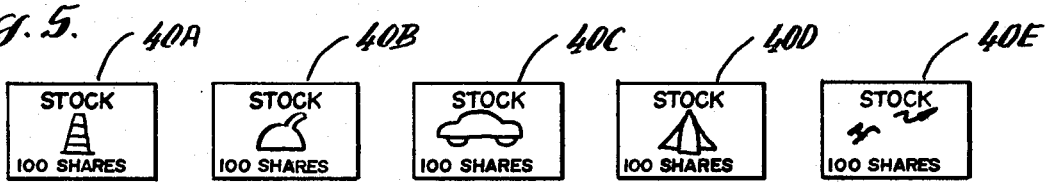
FIG. 5 shows one form for the various stock market certificates, each in round lots of 100 shares.

FIG. 5 shows the stock certificates 40A–E, preferably in multiples of 100 shares, for each of the five industries, specifically the Oil, Chemical, Auto, Space, and Utility industry.

Figure 6:
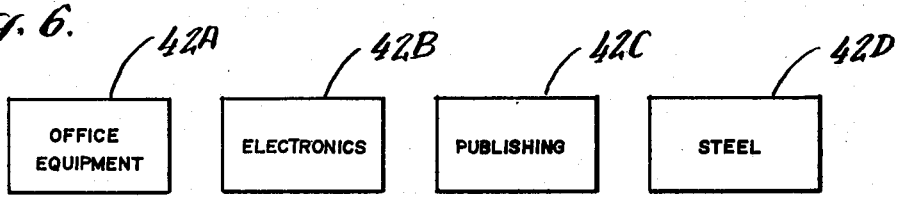
FIG. 6 shows one form for the Corporate Charters for the private corporations.

FIG. 6 illustrates the Corporate Charters 42A–D for the four private corporations representing Office Equipment, Electronics, Publishing, and Steel.

Figure 7:
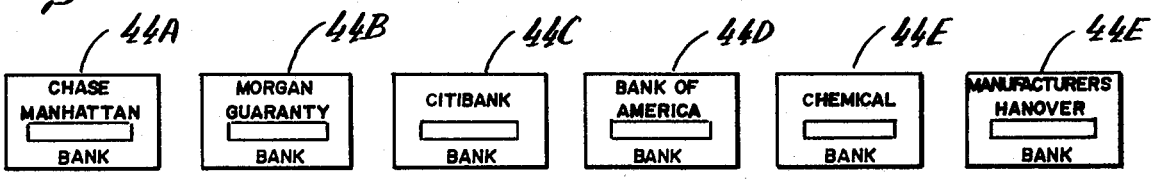
FIG. 7 shows one form for the Bank Loan cards for the private corporations.

FIG. 7 illustrates the Bank Loan cards for six banks, specifically, Chase Manhattan, Morgan Guaranty, Citibank, Bank of America Bank, Chemical, and Manufacturers Hanover Bank. The use of the Bank Loan cards will be explained in more detail below.

Figure 8:
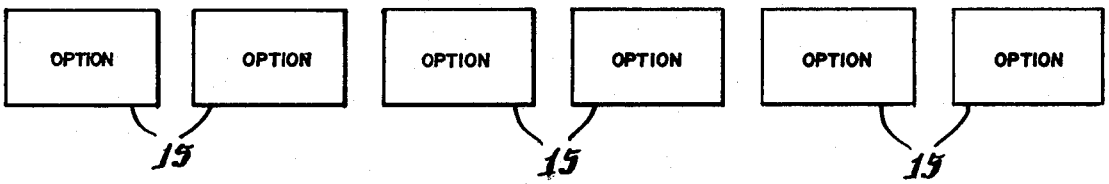
FIG. 8 shows one form for the Option cards used to enter the inner path.

FIG. 8 illustrates the Option cards 15 for the inner path.

Before discussing the Rules of the Game in detail it is believed helpful to focus on some of the basic objectives for winning the game:

1. Buying and selling stocks at a profit;
2. Gaining control of one or more stocks, preferably maintaining control of the stock for a long time, to force other players to pay a premium for the stock, e.g., 2, 5 or 10 times its current market price; and
3. Forming private corporations and selling them at large profits.

Regardless of whether a player does or does not own a particular stock or private corporation, the market price of a stock and the selling price of a private corporation is affected each time any player's token 34 lands on certain predesignated information carrying spaces 20 or 22.

The Stock Market Display 24 behaves in a coordinated unpredictable way; it does not perform hectically. When in control of a stock, a player buys the stock from the Bank or the other players at the market price while the other players are forced to buy it at 2, 5 or 10 times the market price. Therefore, one strategy for winning the game is to obtain control of stocks when their prices are low and keep control until their prices go up. During play of the game, it is easier to lose control of a low priced stock then it is to lose control of a high priced stock for reasons which will become apparent from the discussion of the Rules of the Game below.

Since there is a high probability of a private corporation reaching its maximum selling price in a short period of time, another strategy for winning the game is to form a private corporation and sell it at a substantial profit. This profit is then used to buy stocks, preferably expensive stocks, to obtain and maintain control thereof, hoping that the prices will remain high. A player must either buy at least 100 shares but not more than 500 shares or sell a particular stock each time he/she lands on a brokerage firm space dealing in that stock. A player cannot sell a stock controlled by another player. However, a player must supply it if another player is forced to buy a controlled stock. A stock is always sold to the Bank and first purchased from the Bank. Once the Bank is out of a particular stock, the players to the right of the buyer, going counterclockwise, one after the other, are forced to supply it until the buyer's demand is satisfied. A player is bankrupt if he is unable to complete a buying transaction which he is instructed to perform. Having generally described the game board 10 and appurtenances used with it, the Rules of the Game will now be described.

RULES OF THE GAME

START

Each player selects a token 34 and places it on the space 20A of the outer closed loop path 12 marked "WALL STREET". Initially, each player is given $10,000. One player is chosen to act as Banker or the Banker's duties can be divided among the players, as desired. To determine who goes first, the dice 36 are rolled and the player with the highest roll of the dice 36 goes first, proceeding therefrom in a clockwise direction. The tokens 34 are moved along the outer closed loop path 12 in a clockwise direction in accordance with the number of spaces indicated by the dice 36. A player cannot move backwards. The inner path 14 is accessible only if a player has previously obtained an Option card 15, see FIG. 8. If a player has obtained an Option Card 15, the player can choose to take the option path 14 when a roll of the dice 36 would allow him to land on one of the spaces 22 of the inner path 14 at its entrance end 16. A player normally has only one roll of the dice 36 per turn. However, a player retains the dice 36 and continues to roll them as long as the player continues to throw doubles.

MONEY BONUS

A player collects a money bonus each time his/her token 34 lands on or passes over the space 20A marked "WALL STREET". The amount received is 100 times the total shown on the dice 36. If the dice 36 show a double, 200 times the total is received. For example, on a throw of 6 and 2 totaling 8, the bonus collected is $800. On a throw of double 4, totaling 8, $1,600 is received. Only the throw of dice 36 that causes a player's token 34 to reach or pass over the "WALL STREET" space 20A, is considered in determining the amount of the money bonus to be collected.

STOCK MARKET PRICING DISPLAY

The Stock Market Pricing Display 24 is located on the right hand side of the game board 10 oriented as shown in FIG. 1. As previously mentioned, preferably it includes 4 arrows and 1 line 26A-E. Preferably each arrow bears the color of the industry it represents, i.e., blue for the Chemical Industry, brown for the Space Industry, orange for the Utility Industry, green for the Auto Industry, and red for the Oil Industry. The two arrows 26A and 26E representing the Chemical Industry and the Oil Industry are pointed in one direction, and the remaining two arrows 26B and 26D representing the Space Industry and Auto Industry are pointed in the opposite direction. Along each arrow 26A, B, D and E and the line 26C are nine equally spaced digits forming nine horizontal columns. Each digit represents the price per share of a stock. For example, a 5 on the line 26C represents a price per share of $5 for the Utility stock. At the start of the game, the column marker 28, which is approximately 1"×4", is positioned over the middle horizontal column, as shown in FIG. 1, thereby indicating a price per share of $6 for the Chemical and the Space stocks and $5 for each of the remaining 3 stocks. During the play of the game, depending upon which spaces 20 or 22 a player's token 34 lands on, the marker 28 is moved in discrete steps one column to the left (down) or right (up) as per the instructions on the spaces 20 or 22 indicating that a particular stock price is UP or DOWN. As shown in FIG. 1, the marker 28 is perpendicular to the four arrows and the line 26A–E.

THE STOCK MARKET PRICE PER SHARE IS UP OR DOWN

The purpose of this section is to explain how the Stock Exchange or more particularly the Stock Market Pricing Display 24 interacts with the inner and outer paths 14 and 12, respectively. There are 10 spaces 20 and 22 marked "Price Per Share is . . . " with an "UP" or "DOWN" instruction in the center of each such space. Preferably, each space 20 or 22 also includes the industry of a particular stock and a facade representing, e.g., the New York Stock Exchange. Eight such spaces 20 are interspersed along the outer closed loop path 12 and the remaining 2 spaces 22 are interspersed along the inner path 14. Each time a player lands on one of these spaces 20 or 22 whether he/she owns that particular stock or not, the price per share of the stock represented by that space 20 or 22 is affected either upward or downward depending on the particular instruction, thereby requiring the marker 28 to be moved one column to the left (down) or right (up) or vise versa in the direction of the arrow for that stock. However, movement of the marker 28 also collectively affects the prices of the other stocks. For example, if at the start of the game, a player (whether or not the owner of the stock) lands on the space marked "Price Per Share is UP" for the Oil Industry stock, the marker 28 is automatically moved one discrete step or column in the direction of the arrowhead (Up or to the right)
for the Oil Industry as shown on the sketch below:

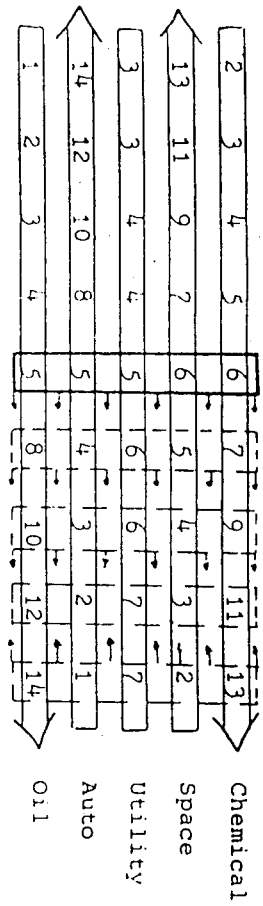

Thus the current market price per share of stock for the Oil Industry would then be $8. The prices of the remaining 4 industry stocks are also affected. The price per share for the Auto and Space Industries falls from $5 to $4 and from $6 to $5, respectively. The price per share for the remaining 2 stocks rise from $6 to $7 for the Chemical Industry and $5 to $6 for the Utility Industry. If subsequently, the same player or another player lands on a space marked "Price Per Share is DOWN" for the Auto Stock whether he/she owns shares in the Auto Industry or not, the marker 28 is moved one discrete step or column in the opposite direction of the Auto arrowhead (as shown down or to the left).

Once the marker 28 reaches the end column at the right end of the display 24 (there are no UP or DOWN spaces 20 or 22 for the Utility Industry), an instruction indicating the price is UP for either the Chemical stock or the Oil stock would not affect the position of the marker 28. That is, the marker 28 remains there until one player lands on a space 20 or 22 instructing that either the price of the Oil or the Chemical stock is DOWN or either the price of the Auto or the Space stock is UP, in which case the marker 28 is moved one discrete step to the column adjacent the end column.

MAJORITY STOCKHOLDERS

A player can control as many industries for which he/she can accumulate the requisite number of shares. You become the Majority Stockholder of of particular stock upon accumulating 1,200 shares (12 units of 100 shares) or more of that stock. At this point, the stock is said to be "controlled". A player in "control" is given the title of Chairman of the Board of the particular Industry or the Utility. That player is also given a small rack (not shown) from the Bank on which he/she places all of the stock certificates 40 which represent that particular stock. Control of a stock is lost once a player's holdings in that stock fall below 1,200 shares, i.e., to 1,100 shares or less. The player also loses the title and the rack is returned to the Bank. A player can control as many industries for which he/she can accumulate the requisite number of shares.

BROKERAGE FIRMS

There are 20 spaces along the outer closed loop path 12 where the 5 stocks are traded in units of 100 shares (round lot units). As previously mentioned, they are the stocks of a Space Industry, Auto Industry, Oil Industry, Chemical Industry and Utility Industry. There are 2,000 outstanding shares or 20 units of each such stock. Four brokerage firms handle transactions of these stocks. They are Merrill Lynch, Shearson Loeb, E. F. Hutton and Solomon Brothers.

Each of the four brokerage firms trades on five of the spaces 20 of the outer path 12, each one of the 5 spaces 20 being associated with a different one of the five industries. Each time a player'token 34 lands on any of these brokerage spaces 20, the player is faces with one of the following decisions:

1. If the stock traded on the space a player's token 34 lands on is not controlled by any player, the player must buy shares (at least 100 shares but not more than 500 shares) in that stock or sell the shares of that stock previously acquired (at least 100 shares). One of these two transactions must be completed. The price per share at which stock is traded is its current market price as indicated by the column framed by the marker 28 of the Stock Market Pricing Display 24. A player has only one choice, i.e., buy the stock if he/she owns no units of that stock.
2. If the stock traded on the space a player lands on is controlled by another player, the player is required to buy and only buy (at least 100 shares but no more than 500 shares) shares in that stock. The player is not allowed to sell shares in that stock that he/she has previously acquired. A player however is obliged to supply that stock, if he/she owns it, to the player who is forced to buy it, as will be described below. The price at which the player buys the stock is either:

a. Two times the current market price. The current market price of each stock is indicated by the column framed by the marker 28 in the Stock Market Pricing Display 24 at the time of the transaction.
b. Five times the current market price if the player controlling the stock is able to reach or pass over the space 20 marked "Annual Stockholder Meeting" three times without once losing control.
c. Ten times the current market price if the player controlling the stock is able to reach or pass over the space 20 marked "Annual Stockholder Meeting" six times without once losing control.

It is the duty of the person acting as Banker to keep track of the number of times a player in control of a stock has reached or passed the Annual Stockholders Meeting space 20. Once control is lost, the stock is traded at its current market value. If a player chooses, e.g., to buy 5 units (500 shares), assuming the Bank is out of the stock and the player whose turn it is to supply these units is in control of the stock and owns 13 units of that stock, the player must pay 2, 5 or 10 times the price for only the 13th and 12th units, for the remaining 3 the player pays only the current market price since control has been lost during the transaction.

3. If the stock traded on the space 20 is controlled by the player whose token 34 landed therein, he/she can either buy at least 100 shares but no more than 500 shares or sell at least 100 shares of the stock or neither buy nor sell any shares in that stock. The price the player buys or sells at in this case is the current market price indicated on the display 24. In other words a player in control of a stock buys his/her shares at the current market price, indicated on the display 24 while a player not in control pays 2, 5 or 10 times the current market price for each share purchased.

Simultaneously, in conjunction with any of the aforementioned decisions, a player can, but is not compelled to sell any units of the other four stocks he/she owns that are not controlled by another player.

THE BUYING TRANSACTION

If a player chooses to buy (decision 1 or decision 3) or if his/her only choice is to buy (decision 2) a particular stock after landing on a brokerage firm space 20 he/she must buy at least 1 unit (100 shares) but no more than 5 units (500 shares) of that stock during that turn. The players must always buy first from the Bank. Once the Bank is out of a particular stock, the player must buy it from the first player on the player's right. Such player is forced to supply it whether it is to his/her advantage or not. Once the first player on the player's right is out of that stock, the player must proceed to the second player to his/her right who is also forced to supply the stock. Then to the third player and so on counterclockwise. The players must proceed in that order without skipping (unless a player whose turn to supply it does not own any units of that stock) until the player's demand is satisfied.

For example, if a player decides to buy 5 units (500 shares) of the Chemical stock upon landing on a brokerage firm space 20 where the stock is traded, the player must buy all 5 units from the Bank, if the Bank owns 5 units or more of the Chemical stock. The player must pay the Bank the current market price, indicated by the marker 28, if the stock is not controlled or if it is controlled by that player. If the stock is controlled by another player, the player whose token 34 landed therein must pay the Bank 2, 5 or 10 times the current market price, as appropriate. If the Bank owns only 2 units of the Chemical stock, and first player on the player's right owns 1 unit, the second player on the player's right owns 3 units, and the third player on your right is in control of the Chemical stock and has passed 3 times over the Annual Stockholder Meeting space 20 without once losing control then the player whose token 34 landed therein must buy the 2 units from the Bank and pay 5 times the current market price, 1 unit from the first player on his/her right and pay him/her 5 times the current market price, and finally the player must pay the second player on his/her right 5 times the current market prices for the remaining 2 units. In this case, the first and second player on the player's right are forced to supply the stock whether it is to their advantage or not. If a player in control of the Chemical stock lands on a space 20 where the Chemical stock is traded and decides to buy additional shares, he/she pays only the current market price indicated by the display 24.

The interaction of the players during the buying transactions simulates an endless supply of stock which is always available on the market for purchase if a player can pay the price.

THE SELLING TRANSACTION

If a player chooses to sell (decision 1 or decision 3) a particular stock after his/her token 34 lands on a brokerage firm space 20, he/she must sell at least 1 unit (100 shares) of that stock per turn. There is no upper limit on the number of units of that stock that can be sold during a turn. However, the player must always sell to the Bank. Stocks are not allowed to be sold to other players.

OPTION TO USE THE INNER PATH

There are two spaces along the outer closed loop path 12 marked "OPTION" where Option Cards (not shown) can be purchased. The price is $1,000. A player owning an Option Card, has the option to use the inner path 14. A player can, but is not forced to purchase one Option Card (not shown) each time the player lands on one of these two spaces 20. A player can accumulate as many Option Cards as desired. However, a player cannot purchase an Option Card from another player. Once purchased, the monetary value of the Option Card is zero. If a player lands on the space 22 in the inner path 14 indicating an Option Card is lost, it must be returned to the Bank.

FORMING A PRIVATE CORPORATION

A private corporation comprises 1,000 shares totally owned by one and only one player, from the time it is formed to the time it is sold. There are 4 private corporations available for full ownership. They are a Publishing, Electronics, Office Equipment and Steel. To form a private corporation, a player must simultaneously have in his/her possession both a Bank Loan Card 44A–F and a Corporation Charter Card 42A–D. The player may acquire these two cards in any order. Once both of these cards are acquired, the acquiring player automatically becomes owner of the private corporation whose name is shown on that Corporation's Charter Card 42A–D. At that time, the player obtains a small marker (not shown), e.g., 1"×1", from the Bank and places it over digit 3 ($3/share) on the particular arrow 32A–D representing that corporation in the Private Corporation Display 30. A player can own only one private corporation at any one time, during the game.

BANK LOAN CARDS

There are six spaces 22 along the inner path 14 marked "BANK LOAN" where Bank Loan Cards are purchased. Each time a player lands on one of these spaces he/she is entitled, but not required to buy one Bank Loan Card. The price is $1,000. A player can accumulate as many Bank Loan Cards as he/she desires. However, they cannot be purchased from another player. Once purchased, their monetary value is zero. As desired, various names of well known Banks may be incorporated in the six spaces 22 and/or on the Bank Load Cards 44A–F

CORPORATION CHARTER CARDS

There are also six spaces along the inner path 14 marked "PRIVATE CORPORATION CHARTER" where Corporation Charter Cards 42A–D may be purchased. Each time a player lands on one of these spaces 22 he/she is entitled, but not forced, to buy a Card for the Corporation's Charter specified on that space 22, if it is available from the Bank. The price is $1,000. If the space 22 does not specify a particular corporate charter (there are two of them), then the player is entitled to buy any one he/she desires which is available from the Bank. A player may own only one Corporation Charter Card 42A–D at a time. A player is not permitted to buy Corporation Charter Cards 42A–D from another player. Once purchased, the monetary value of the card is zero.

PRIVATE CORPORATION PRICING DISPLAY

This display 30 is located on the left hand side of the board as oriented in FIG. 1. It includes four arrows 32A–D pointed in the same direction. Each arrow 32A–D bears the same color as the private corporation it represents. Preferably each arrow, includes seven digits. Each digit represents the selling price of one share of stock. Thus, a 10 along the yellow arrow, representing Publishing, means that the current selling price of the Publishing corporation is $10 per share, for 1,000 shares or $10,000. From the time a corporation is formed, and a pricing marker (not shown) is placed over digit three on its representative arrow 32A–D, until that corporation is sold by its owner, a player whose token 34 lands on certain spaces 20 or 22, whether or not an owner, will affect, one step upward (left) or downward (right) at a time, the position of the pricing marker.

PRIVATE CORPORATION SELLING PRICE

There are nine spaces 20 and 22 marked "Profits for Private Corporations" with an "UP" or "DOWN" instruction in the center. Five of these spaces 20 and 22, four of which are located along the outer path 12 and one along the inner path 14, simultaneously affect the selling price of all four private corporations. The remaining 4 spaces 22, all located along the inner path 14, only affect the selling price of a particular corporation.

From the time a private corporation is formed to the time it is sold by its owner, each time a player reaches one of the private corporation spaces 20 or 22, whether he/she owns the corporation or not, the selling price of the private corporation is affected either positively or negatively depending on the instruction in the space 20 or 22. For example, if player number one owns the Steel corporation, meaning he/she has in his/her possession one Bank Loan Card and one Corporation Charter Card labeled Steel and the pricing marker has already been placed along the green arrow for Steel, and player number two owns the Publishing corporation, with no one owning the remaining two corporations, then each time any of the players reaches a space 20 or 22 marked: "Profits For all Four Private Corporations Are UP", the markers along the Steel arrow 32D and the Publishing arrow 32B are separately moved one step UP in the direction of the respective arrowheads. Once a marker reaches the maximum per share value here 23, any player landing on such spaces 20 or 22 would not affect the position of the pricing marker. The pricing marker remains there until the corporation is sold or until a player lands on a space instructing that the marker for that particular corporation is to be moved one step DOWN. If the profits for all four private corporations are DOWN, the two markers are separately moved one step downward in the opposite direction of the respective arrowheads. Once a marker reaches digit 1 then landing on a DOWN space 20 or 22 would not affect its position. The pricing marker remains there until the corporation is sold or until a player lands on a space instructing the pricing marker to be moved UP one step. If the player lands on the space bearing the instruction "Profits for the Steel Corporation are UP", the pricing marker along the Steel arrow is moved UP one step in the direction of the arrowhead, the other markers are not affected. The pricing markers will normally not be at the same level along their respective arrows 32A–D since the individual private corporations are formed separately, at different times by different players.

A player may, but is not required to, sell his/her private corporation, at full price, if the player's token lands on any one of the six spaces 22 marked "PRIVATE CORPORATION CHARTER" located on the inner path 14. A player may sell his/her private corporation at half price any time during his/her turn, either before or after he/she rolls the dice 36. The price at which a private corporation is sold is 1,000 times, (representing 1,000 shares) the current price per share as indicated by the position of the pricing marker on the arrow 32A–D representing that corporation. A private corporation is always sold to the Bank. Moreover, it cannot be partially sold. If a private corporation is sold, the player must return both the Corporation's Charter Card and one Bank Loan Card (a player might own more than on Bank Loan Card) to the Bank. Also, the pricing marker located on the arrow representing that corporation is returned to the Bank. However, concurrently, the player may form a new corporation while still on the PRIVATE CORPORATION CHARTER space 22. However, the player must possess another Bank Loan Card in addition to the one he/she just returned to the Bank, and also be on a space, where he/she can purchase a Corporation Charter Card, different from the one he/she just returned to the Bank. Finally, the Corporation Charter 42A–D for the new corporation must also be available from the Bank. Each time a new private corporation is formed the owner must place the pricing marker over the digit three on the arrow 32A–D representing that corporation.

BANKRUPTCY

A player is bankrupt if he/she does not have enough assets (stock, cash or private corporations) to fulfill a transaction. A player is also bankrupt if he/she must sell a stock controlled by another player to fulfill a transaction. A bankrupt player must turn over all his/her assets to the Bank and leave the game. However, the Bank must finish this last transaction by buying one unit of the stock from the player who was supposed to supply it to the bankrupt player. This unit is purchased at the price the bankrupt player should have paid. Each such unit redeemed by the Bank is added to its supply of stock for sale if a player lands on the right spaces 20.

WINNING

The winner is the last player left in the game after all the other players have gone bankrupt.

It should be apparent to those skilled in the art that various modifications may be made in the present invention. For example, the game may be readily adapted to international finance by utilizing foreign exchange rates. In this regard, the Stock Market Pricing Display 24 may include five stocks from five different countries. An Exchange Rate Display would provide the current exchange rates in relation to the dollar. The players using dollars would have to complete transactions under favorable or unfavorable exchange rates and under favorable or unfavorable stock market prices. Such an adaption should be considered within the spirit and scope of the invention as described in the specification and defined in the appended claims.

What is claimed is:

1. A financial board game for providing enjoyment to the players in addition to serving as a financial teaching aid, comprising:

a board having a closed loop path divided into a plurality of discrete spaces interconnected to one another, each space providing an instruction for a player whose token lands thereon during movement along the path, a stock market pricing display including a plurality of stocks having a plurality of indicia indicating different stock values, certain of said spaces of said closed loop path having instructions thereon indicating that a particular stock has gone up or down being designated a first group, marker means movable to correlate with instructions from said first group of spaces for collectively changing the indicia for all the stocks to correlate with an instruction from one of said spaces of said first group indicating a change in value of a particular stock;

said indicia for the stocks of said stock market pricing display are selected so that the stocks of said stock market pricing display increase or decrease in a coordinated manner with at least two of the stocks rising in price while at least two other stocks are falling in price, said indicia being further arranged to form a plurality of columns, said marker means being movable to correlate with instructions from said spaces of said first group of spaces to frame a particular column and thereby indicate the current market value for all of the stocks;

an inner path interconnecting said closed loop path, said inner path being divided into a plurality of discrete spaces interconnected to one another, each such discrete space providing an instruction for a player whose token lands thereon, the first space of said inner path being contiguous with one of said spaces of said closed loop path to provide entry onto said inner path from said closed loop path and the last space of said inner path being contiguous with another of said spaces of said closed loop path to provide exit from said inner path onto said closed loop path; and other spaces of said closed loop path being designated a second group, said other spaces enabling a player to gain control of a stock when a player's token has landed thereon a sufficient number of times by purchasing a predetermined number of shares of the stock whereby the value of the controlled stock indicated on said stock market pricing display is multiplied.

2. The financial board game recited in claim 1, wherein:

one of said spaces of said closed loop path enables a player in control of a stock to multiply the value of the stock indicated on said stock market pricing display if the player's token passes said one space a predetermined number of times.

3. The financial board game recited in claim 2, wherein:

said inner path includes a first group of spaces upon which a player's token must land to satisfy a first requirement to enable a player to acquire ownership of a private corporation and a second group of spaces upon which the same player's token must land to satisfy a second requirement to enable a player to acquire ownership of a private corporation.

4. The financial board game recited in claim 3, wherein:

said closed loop path has at least one designated space upon which a player's token must land prior to the player gaining access to said inner path.

5. The financial board game recited in claim 3, including:

a private corporation pricing display including a plurality of private corporations, each of said private corporations having a plurality of indicia associated therewith for correlating with a third group of spaces interspersed along said inner and outer paths for indicating a change in the current indicia of said private corporations;

private corporation marker means for indicating the current value of said private corportions.

6. A financial board game for providing enjoyment to players in addition to serving as a financial teaching aid, comprising:

a board having a closed loop path divided into a plurality of discrete spaces interconnected to one another, each discrete space providing an instruction to a player whose token lands thereon during movement along the closed loop path; and a stock market pricing display including a plurality of stocks, each of said stocks having a plurality of indicia associated therewith, said indicia of said stock market pricing display are selected such the indicia of a first group of two of said stocks are identical but with the direction of the indicia reversed relative to one another, and the indicia of a second group of two of the stocks are identical but with the direction of the indicia reversed relative to one another, said plurality of indicia of said stocks being aligned in columns, some of said discrete spaces of said closed loop path having instructions thereon for correlating with said stock market pricing display for indicating that a particular stock has risen or fallen in value and other discrete spaces having instructions thereon indicating that shares of a particular stock may be purchased;

stock value marker means for marking a column of said indicia of said stocks to collectively display the current value of each of said stocks, said marker means being movable to an adjacent column of said indicia to provide new indicia for the current value of all of said stocks in response to an instruction from said discrete spaces of said closed loop path which indicate that a particular stock has risen or fallen in value when the token of a player lands thereon, whereby a player whose token lands on a sufficient number of discrete spaces allowing the purchase of a particular stock gains control of the stock when the player accumulates a predetermined number of shares of the stock entitling such player to thereafter receive a multiple of the current value of such stock displayed by said stock market pricing display when another player purchases shares of the controlled stock.

7. A financial board game for providing enjoyment to players in addition to serving as a financial teaching aid, comprising:

a board having a closed loop path divided into a plurality of discrete spaces interconnected to one another, each discrete space providing an instruction to a player whose token lands thereon during movement along the closed loop path;

a stock market pricing display including a plurality of stocks, each of said stocks having a plurality of indicia associated therewith, said plurality of indicia of said stocks being aligned in columns, some of said discrete spaces of said closed loop path having instructions thereon for correlating with said stock market pricing display for indicating that a particular stock has risen or fallen in value and other discrete spaces having instructions thereon indicating that shares of a particular stock may be purchased;

stock value marker means for marking a column of said indicia of said stocks to collectively display the current value of each of said stocks, said marker means being movable to an adjacent column of said indicia to provide new indicia for the current value of all of said stocks in response to an instruction from said discrete spaces of said closed loop path which indicate that a particular stock has risen or fallen in value when the token of a player lands thereon;

one of said discrete spaces designated a control space, so that when a player whose token has landed on a sufficient number of discrete spaces allowing the purchase of a particular stock gains majority ownership of the stock by accumulating a predetermined number of shares of that stock, the current value of the stock displayed by said stock market pricing display is multiplied when the player having majority ownership of the shares of that stock passes said control space a predetermined number of times without losing control;

an inner path interconnecting said closed loop path, said inner path being divided into a plurality of discrete spaces interconnected to one another, each of said spaces of said inner path providing an instruction for a player whose token lands thereon, the first space of said inner path being contiguous with one of said spaces of said closed loop path to provide entry onto said inner path from said closed loop path and the last space of said inner path being contiguous with a different space of said closed loop path to provide exit from said inner path onto said closed loop path;

a private corporation pricing display including an plurality of private corportions, each of said private corporations having a plurality of indicia associated therewith, certain discrete spaces of said inner path having instructions thereon for correlating with said private corporation pricing display for indicating a change in the current indicia of a private corporation;

private corporation marker means for use with said private corporation display to indicate the current indicia of said private corporations;

said private corporation marker means being movable to correlate with an instruction from said discrete spaces of said closed loop path which indicates a change is to be made in the current indicia of said private corporation when the token of a player lands thereon;

said inner path includes a first group of designated spaces upon which a player's token must land to acquire a first card and a second group of designated spaces upon which a player's token must land to acquire a second card, possession of said first and second cards being required to provide the player with ownership of one of said private corporations.

8. The financial board game recited in claim 7, wherein:

simultaneously with a player's token landing on one of the spaces of the second group of spaces so that the player acquires the second card, that player becomes the owner of the private corporation designated on the second card.

9. The financial board game recited in claim 7, wherein:

said first group of spaces correlate with said private corporation pricing display to establish the selling price of a particular private corporation when the token of a player in possession of said first and second cards for a private corporation lands on a space of said first group of spaces which designates that private corporation.

* * * * *